US011299335B1

(12) United States Patent
Obeyesekere et al.

(10) Patent No.: US 11,299,335 B1
(45) Date of Patent: Apr. 12, 2022

(54) FLEXIBLE PACKAGING RIB STIFFENERS

(71) Applicant: Amazon Technologies, Inc., Seattle, WA (US)

(72) Inventors: Vasitha Nihal Obeyesekere, Seattle, WA (US); Alexandra Kay Hartford, Seattle, WA (US); Justine Mahler, Seattle, WA (US); Kimberly Sue Houchens, Seattle, WA (US); Brent Linderberg, St. Charles, IL (US); Jenna Walsh, Batavia, IL (US)

(73) Assignee: Amazon Technologies, Inc., Seattle, WA (US)

( * ) Notice: Subject to any disclaimer, the term of this patent is extended or adjusted under 35 U.S.C. 154(b) by 58 days.

(21) Appl. No.: 16/369,566

(22) Filed: Mar. 29, 2019

(51) Int. Cl.
*B65D 81/03* (2006.01)
*B65D 27/02* (2006.01)

(52) U.S. Cl.
CPC ..... *B65D 81/03* (2013.01); *B65D 27/02* (2013.01)

(58) Field of Classification Search
CPC ..... B65D 81/03; B35D 33/02
USPC ..... 229/87.02–87.03; 383/119, 120, 105
See application file for complete search history.

(56) References Cited

U.S. PATENT DOCUMENTS 2,364,575 A * 12/1944 Warren ..... B65D 65/22 383/105
4,096,987 A * 6/1978 Rodish ..... B65D 33/02 383/119
2004/0000581 A1* 1/2004 Brandolini ..... B32B 27/36 229/68.1
2004/0005100 A1* 1/2004 Versluys ..... B65D 33/02 383/119
2005/0226542 A1* 10/2005 Kendall ..... B65D 27/32 383/207
2006/0177161 A1* 8/2006 Turvey ..... B65D 33/2591 383/120
2010/0278461 A1* 11/2010 Veiseh ..... B65D 81/03 383/107
2014/0117071 A1* 5/2014 Kannankeril ..... B65D 81/03 229/68.1
2018/0057214 A1* 3/2018 Chen ..... B65D 81/03

FOREIGN PATENT DOCUMENTS

CA 2270748 A1 * 10/1999 ..... B65D 81/3897
DE 2437968 A1 * 2/1976 ..... B65D 81/03

OTHER PUBLICATIONS

Machine Translation of DE-2437968-A1 (Year: 1976).*

* cited by examiner

*Primary Examiner* — Nathan J Newhouse
*Assistant Examiner* — Phillip D Schmidt
(74) *Attorney, Agent, or Firm* — BakerHostetler

(57) ABSTRACT

A padded mailer includes ribs that provide stiffness, especially in the transverse direction. The increased stiffness helps prevent the mailer from flipping over during conveying, which would put a label on the underside of the mailer.

15 Claims, 11 Drawing Sheets

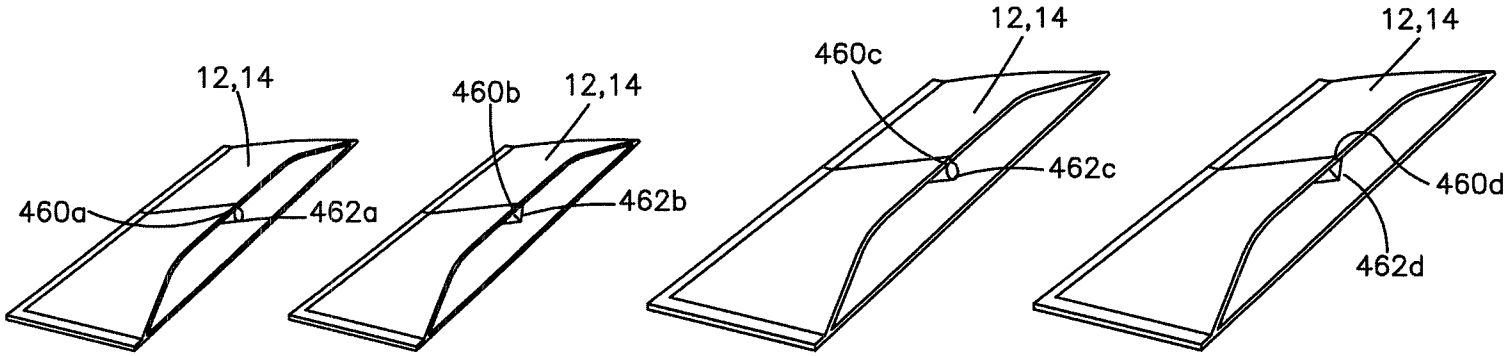
Fig.9A
Fig.9B
Fig.10A
Fig.10B
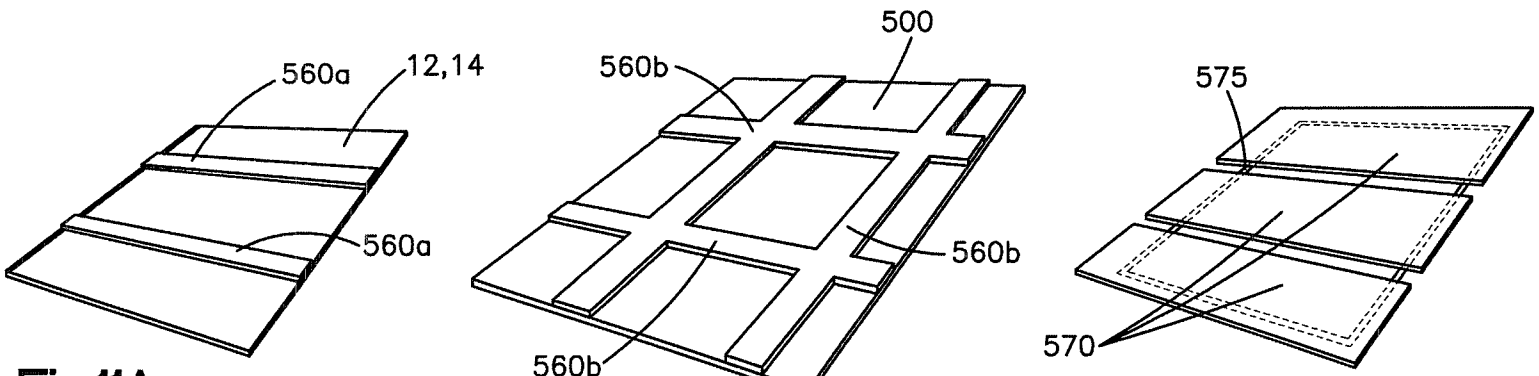
Fig.11A
Fig.11B
Fig.11C

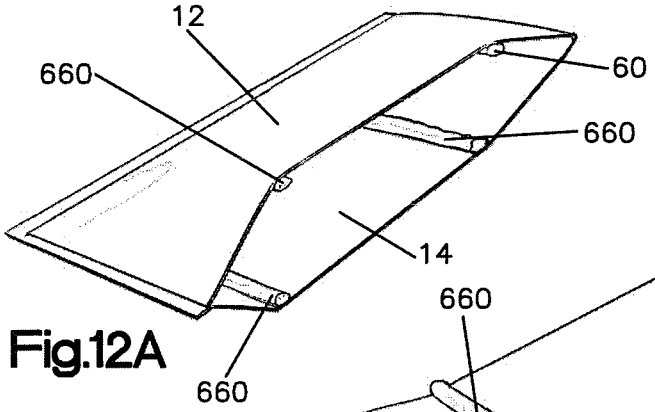
Fig.12A
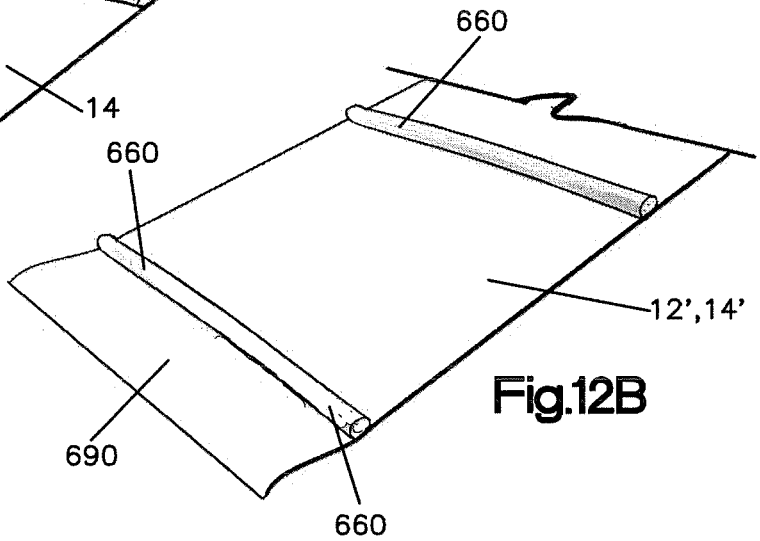
Fig.12B
Fig.13A
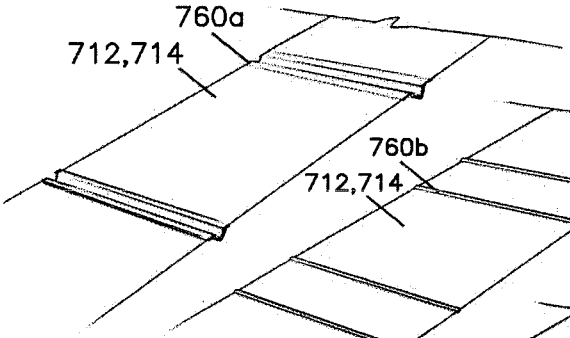
Fig.13B
Fig.13C
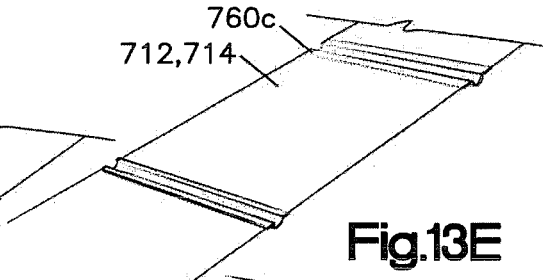
Fig.13E
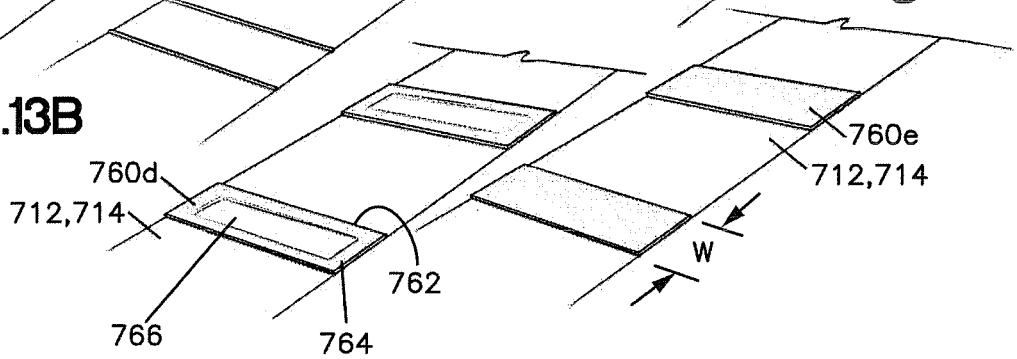
Fig.13D

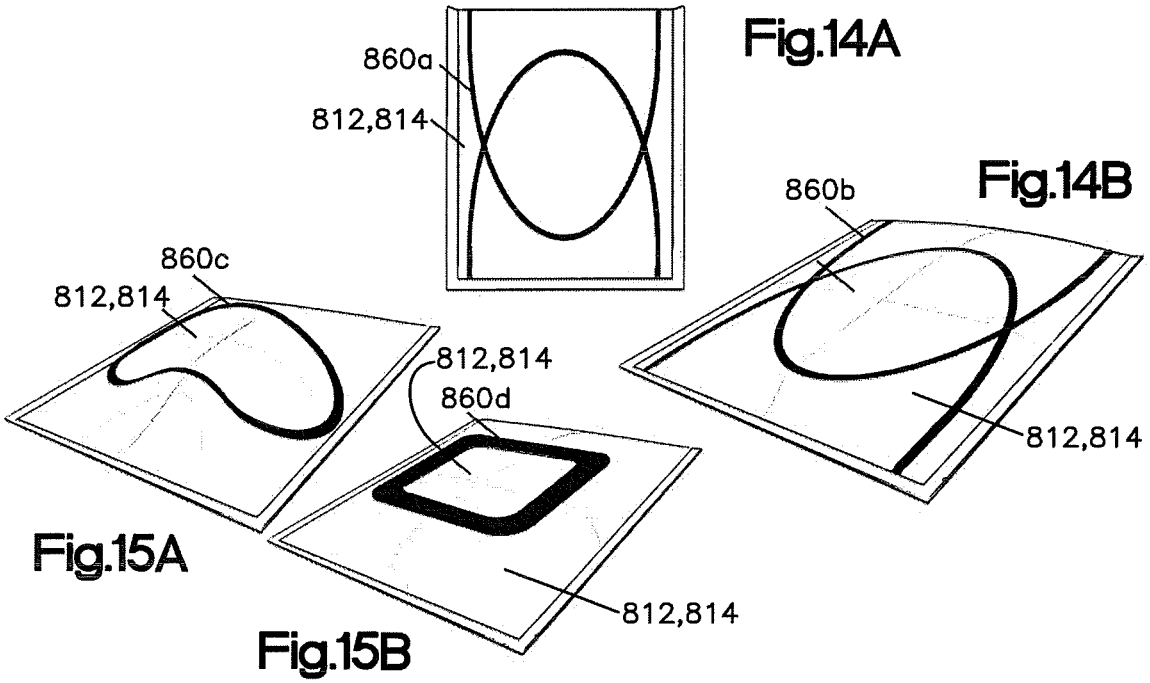
860a
812,814
Fig.14A
860b
Fig.14B
860c
812,814
812,814
860d
812,814
Fig.15A
812,814
Fig.15B
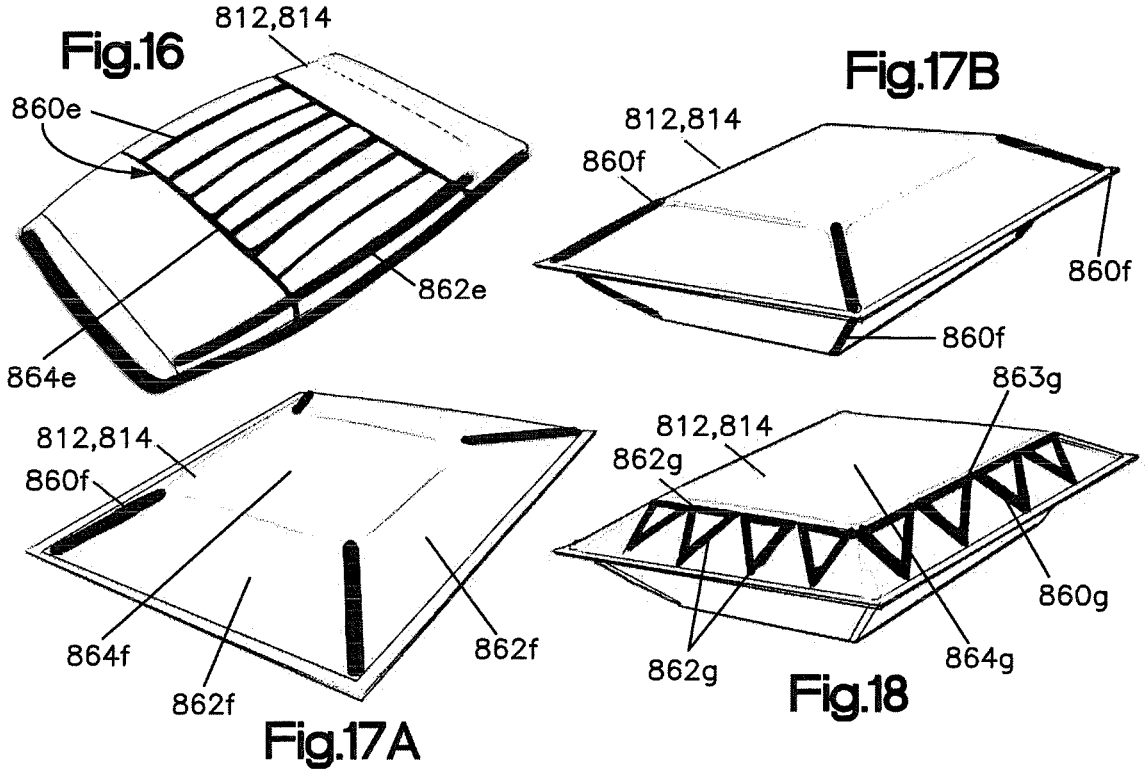
Fig.16
812,814
860e
862e
864e
Fig.17B
812,814
860f
860f
860f
812,814
860f
864f
862f
862f
Fig.17A
863g
812,814
862g
860g
862g
864g
Fig.18

Fig.19A
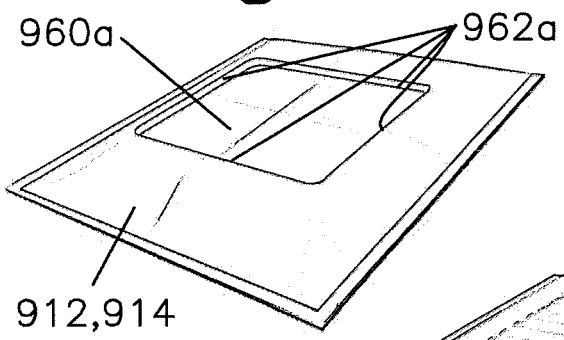
Fig.19B
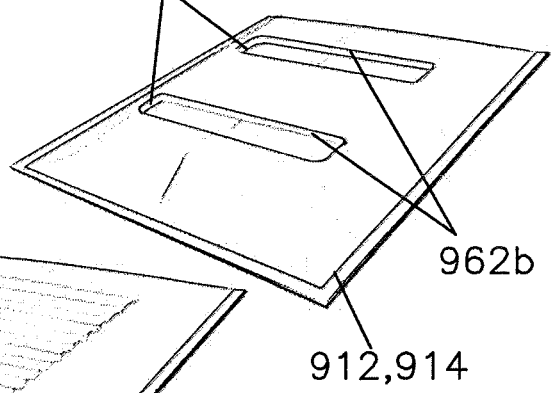
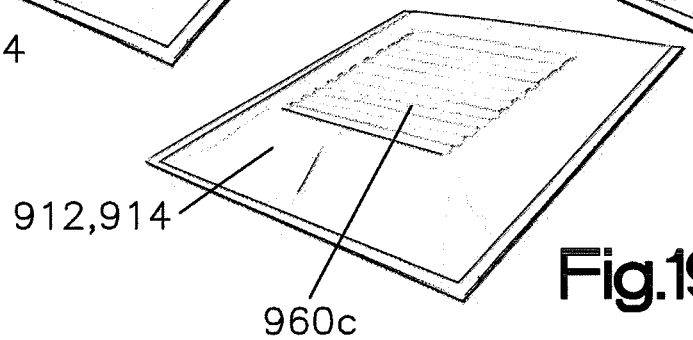
Fig.19C
Fig.20A
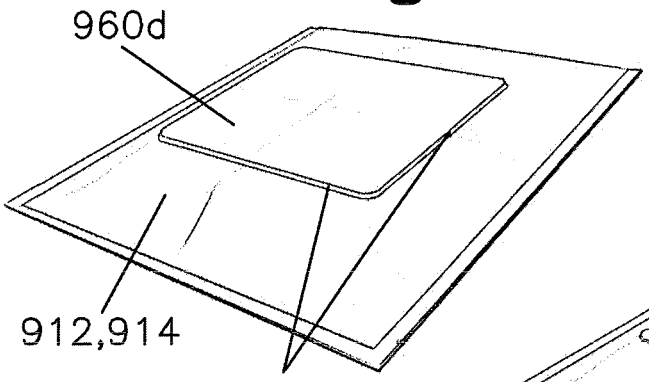
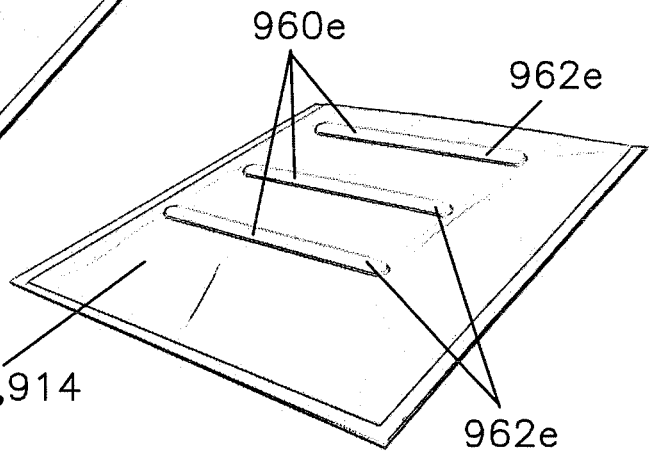
Fig.20B Fig.22
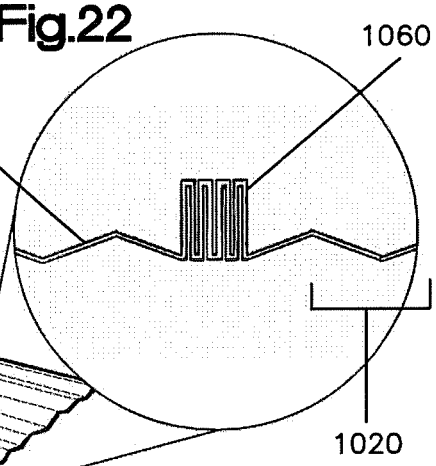
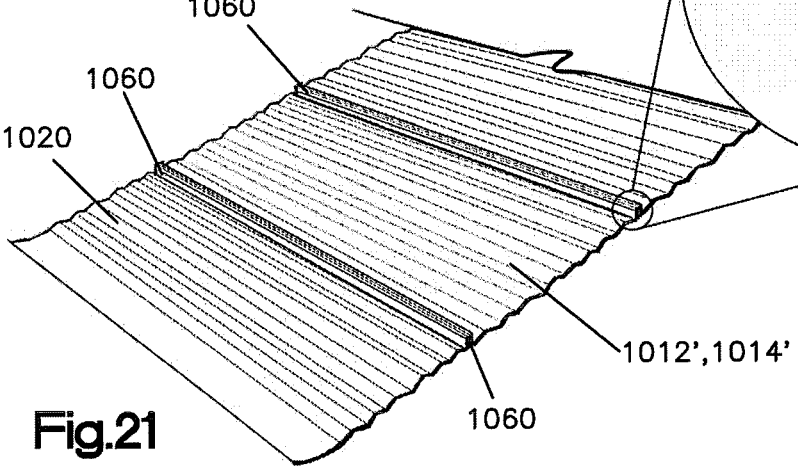
Fig.21
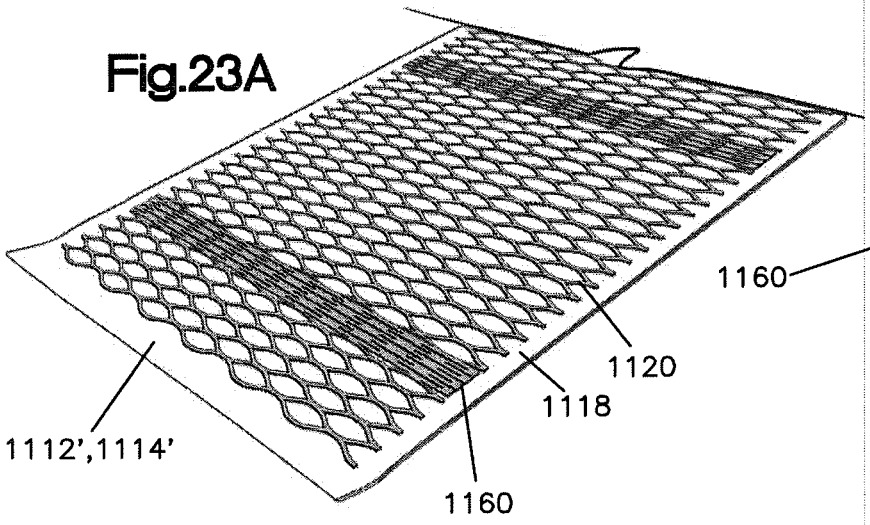
Fig.23A
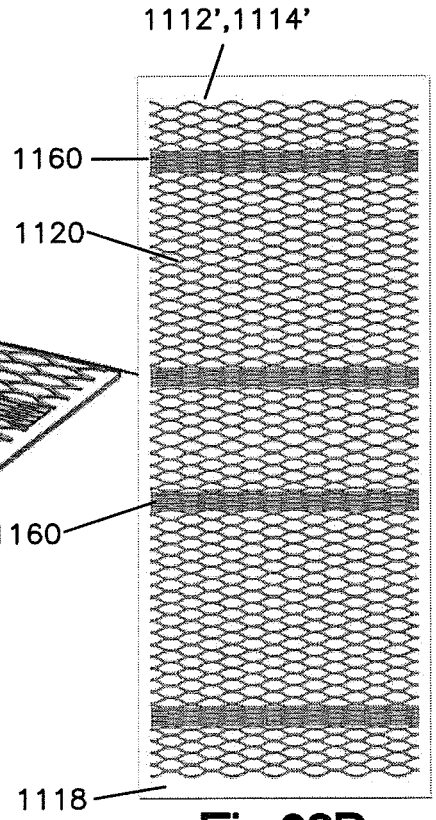
Fig.23B Fig.24A
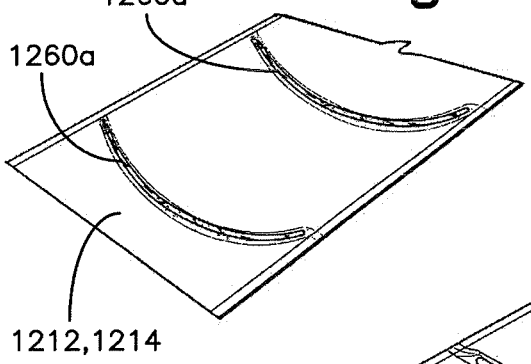
Fig.24B
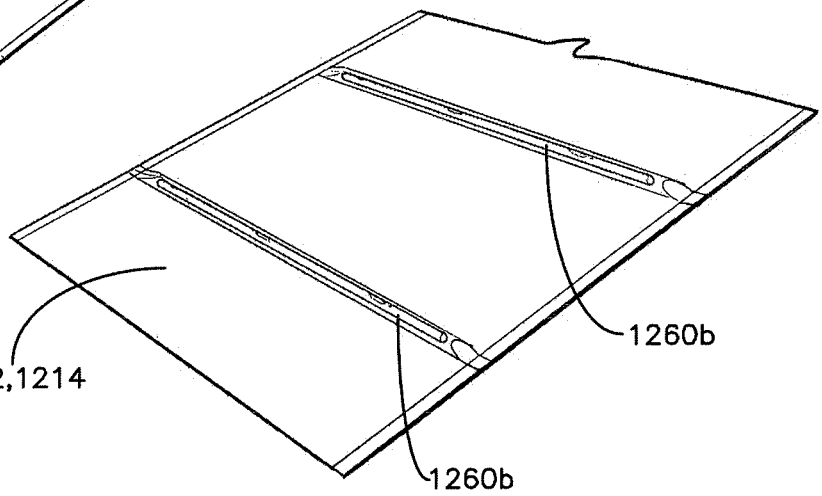
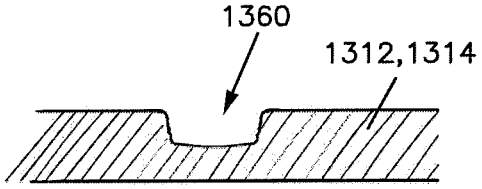
Fig.25C
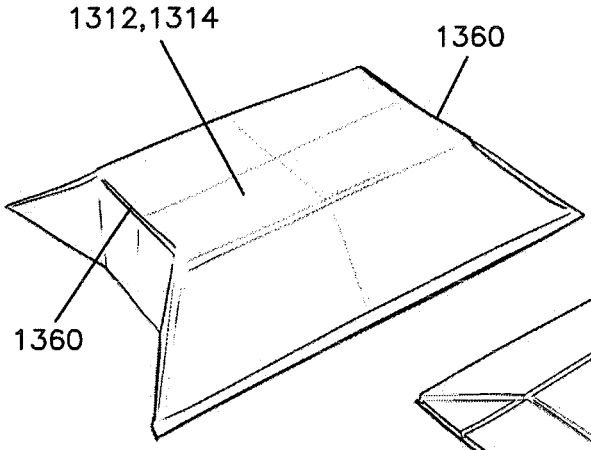
Fig.25B
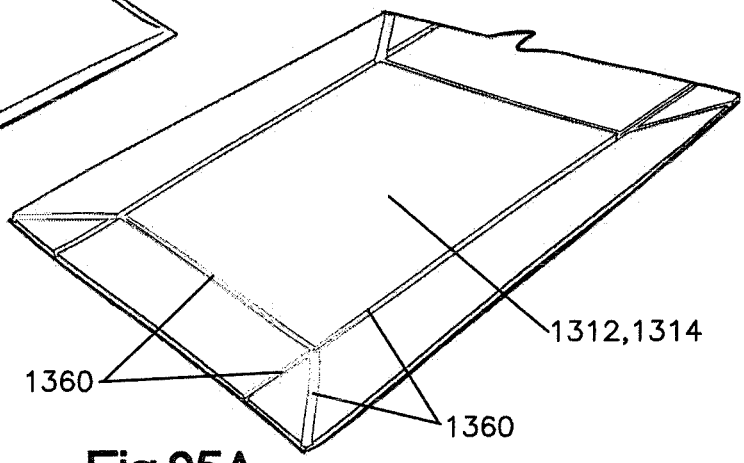
Fig.25A 1560a
12
14

1560b
14
12

1560c
14
12

1560d
14
12

FLEXIBLE PACKAGING RIB STIFFENERS

BACKGROUND

This invention is related to packaging, and more particularly to flexible packaging, including mailers or pouches, in some cases having cushioned sidewalls.

A vast number of items are handled and shipped in envelopes or pouches that have cushioned sidewalls, generally referred to as padded mailers. A conventional padded mailer typically includes a pair of opposing sidewalls having an outer surface of a heavy paper, paperboard, corrugated fiberboard or plastic film. The padding inside the sidewalls is newsprint, foam, air-filled cells, or other cushioning materials. A conventional mailer typically has a folded end, a pair of opposing seams or seals at its lateral edges, and an opening for inserting items.

Sheets of air-filled cells, often referred to as bubble wrap, are formed by thermoforming a first polymer film into cavities on a drum-shaped mold and then laminating another polymer film onto the first film to trap air into the cavities to form air-filled cells. The cells typically are curved (in top view), often hemispherical in shape. Cells can also be cylindrical or conical. LDPE or HDPE is often used for the film material.

The cells are arranged in rows, typically with each row is alternating or offset from its adjacent row, which increases the packing density of the rows.

BRIEF DESCRIPTION OF THE DRAWINGS

FIG. 9A is a schematic view cross-sectional illustrating a circular rib that is filled;

FIG. 9B is a schematic view of a tiangular rib that is filled;

FIG. 10A is a schematic cross-sectional view illustrating a circular rib that is filled, formed of a double layer sidewall material;

FIG. 10B is a schematic cross-sectional view illustrating a triangular rib that is filled, formed of a double layer sidewall material;

FIG. 11A is a view of a mailer having an expanded adhesive or like material that forms a rib;

FIG. 11B is a view of a second embodiment of the expanded adhesive or like material;

FIG. 11C is a schematic view of an apparatus used in applying energy to the structure of FIG. 11*a;*

FIG. 12A is a perspective cross-sectional view of a mailer having foam ribs;

FIG. 12B is a view of a sheet used to form the mailer of FIG. 12A;

FIG. 13A is a view of a sheet used for forming a mailer having a rigid rib formed in the mailer sidewall;

FIG. 13B is a view of a second embodiment of a sheet used for forming a mailer having a rigid rib formed in the mailer sidewall;

FIG. 13C is a view of a third embodiment of a sheet used for forming a mailer having a rigid rib formed in the mailer sidewall;

FIG. 13D is a view of a fourth embodiment of a sheet used for forming a mailer having a rigid rib formed in the mailer sidewall;

FIG. 13E is a view of a fifth embodiment of a sheet used for forming a mailer having a rigid rib formed in the mailer sidewall;

FIG. 14A is a top view of a mailer having rigid inclusion ribs formed therein;

FIG. 14B is a perspective view of the mailer of FIG. 14A;

FIG. 15A is a perspective view of a mailer illustrating a second embodiment rigid inclusion;

FIG. 15B is a perspective view of a mailer illustrating a third embodiment rigid inclusion;

FIG. 16 is a perspective view of a mailer illustrating a fourth embodiment rigid inclusion;

FIG. 17A is a perspective view of a mailer illustrating a fifth embodiment rigid inclusion;

FIG. 17B is a perspective view of a mailer illustrating a fifth embodiment rigid inclusion, and including inclusions in both the top and bottom sheet;

FIG. 18 is a perspective view of a mailer illustrating a sixth embodiment rigid inclusion;

FIG. 19A is a perspective view of a mailer having a deboss;

FIG. 19B is a perspective view of a mailer having a second embodiment deboss;

FIG. 19C is a perspective view of a mailer having a corrugated portion;

FIG. 20A is a perspective view of a mailer having an emboss;

FIG. 20B is a perspective view of a mailer having a second embodiment emboss;

FIG. 21 is a view of a sheet used for forming a mailer that is formed of corrugations, with ribs formed of the corrugations;

FIG. 22 is an enlarged view of a portion of the sheet of FIG. 21;

FIG. 23A is a view of a sheet used for forming a mailer that is formed of a film and an expanded material, with ribs formed of the expanded material;

FIG. 23B is a top view of the sheet of FIG. 23A;

FIG. 24A is a perspective view of a mailer having a rib ready to be formed by deforming the rib to allow chemicals within the rib to mix;

FIG. 24B is a perspective view of a mailer having a second embodiment rib of FIG. 24A;

FIG. 25A is a perspective view of a mailer having channels that form hinges in the sidewall of the mailer;

FIG. 25B is a perspective view illustrating the mailer of FIG. 25A having an item inducted therein;

FIG. 25C is a perspective view of a mailer having a second embodiment channels that form hinges in the sidewall of the mailer;

DETAILED DESCRIPTION OF ILLUSTRATIVE EMBODIMENTS

Figure 1:
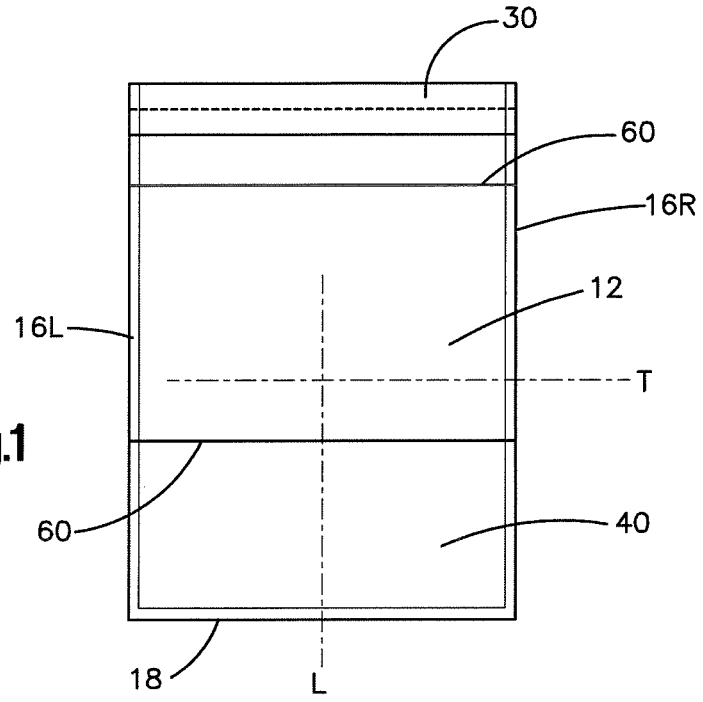
FIG. 1 is a top view of a first embodiment flexible package including stiffening ribs.

The uniform shape of air-filled cells in padded mailers that are oriented in rows promotes bending in several directions. Because the lands (that is, the portion of the sheet that is between the air-filled cells) have little resistance to bending, a sheet of air-filled cells has very low stiffness in almost any direction. The term stiffness is a measure of the resistance to deformation in response to a force. As used herein, the term stiffness applies to resistance to a force that induces bending in a sheet.

In general, if a packaging designer desires stiffness in a padded mailer, such as to provide protection against bending for an easily-damaged item within the mailer, a paperboard or like structural layer could be used with sufficient thickness to achieve the desired protection. Thus, a padded mailer having a paper or like structural layer was preferred over a padded mailer having a cover-layer of a polymer film, without a paperboard structural layer, when stiffness was required.

But advances in packaging technology and operations have created a new problem relating to mailers. As the number of items handled and transported increases, the number of mailers having thin, flexible outer layers has increased. And in this context, the inventors have found that some mailers flip over during conveying or other handling, or some mailers are unintentionally ejected from conveyors or other handling equipment, such as where direction or speed changes occur during conveying.

Flexible packaging, such as mailers, that are ejected from a conveyor are no longer within the automated system, and a mailer that is flipped cannot be read by scanners if the identifying information (such as a bar code or 2D code) is unintentionally on the underside of the mailer.

The inventors have found that certain-shaped items, such as spherical, other items that are tall relative to the mailer dimensions, or flowable items (such as marbles, make the mailer prone to flipping in some circumstances—often about its longitudinal axis. The inventors address this new problem by increasing the lateral stiffness of the mailer, which diminishes the likelihood that the mailers will flip over unintentionally.

Generally speaking, compressing plastic to form "ribs" in some cases requires removing material and increasing rigidity of the material in the rib region. Removing material and increasing rigidity is considered undesirable because it weakens the material. But such ribs can be useful in controlling how a mailer moves and flips along a conveyor below. The rib technique employed here in some cases fuses material together to compensate for the material removed in heating while enabling good rigidity across the short axis to minimize likelihood of flipping.

Further, the term "flexible packaging" is used herein to refer to mailers, pouches, bags, and like packages that have flexible sidewalls, such as (but not limited to) plastics such as LDPE, HPDE, PLA, PHA Polyesters, PCL polyesters, polyester, nylon, PVC, cellulose-based plastic, starch-based plastic, protein-based plastic, PVA Film, Casein (milk protein); Woven fiber such as Woven Polypropylene or Woven Polyethylene; or fiber construction such as HDPE fiber (such of the type sold under the tradename Tyvek®), Cellulose-based paper (an example of which is sold under the tradename Paptic®), Hemp Fiber, or molded fiber; metal-based sidewalls, such as a metal foil or metalized polymer; or biomaterials and metamaterials (electromagnetic, elastic, acoustic, etc.).

The term "mailer" as used herein refers to any pouch, bag, and the like, including structures that are manufactured with an opening later filling with an item (such mailer 10 of FIG. 8) and mailers that are formed contemporaneously from a sheet, and thus typically have three heat sealed edges and a folded edge (such as mailer 10 in FIG. 9).

Referring to FIG. 1, an example of flexible packing, in this case in the form of a padded mailer 10, includes an upper sidewall 12 and an underside sidewall 14 (not shown in FIG. 1). The term "underside" as used herein is merely for reference to identify the sides when in the particular orientation illustrated in the figures, as the figures show a mailer without a label.

A cover layer 40, as illustrated in the Figures, preferably is a conventional polymer film, such as LDPE, HDPE, or other polymer, or without limitation any of the materials listed above relating to the sidewalls. A padded layer 50 (optional) is within cover layer 40. Padded layer 50 in the embodiment of the figures includes gas-filled cells that perform the cushioning function. It is understood that the term "gas-filled" used herein is typically air-filled.

Sidewalls 12 and 14 are joined together at lateral seams 16L and 16R and at an upper edge that defines an upper seal 30. Sidewalls 12 and 14 are also joined together at a fold 18 at the bottom of mailer 10. Mailer 10 forms a longitudinal axis L and a transverse axis T. A pair of transversely oriented ribs 60 are formed in sidewall 12 and optionally in sidewall 14 (not shown in FIG. 1).

Figure 2:
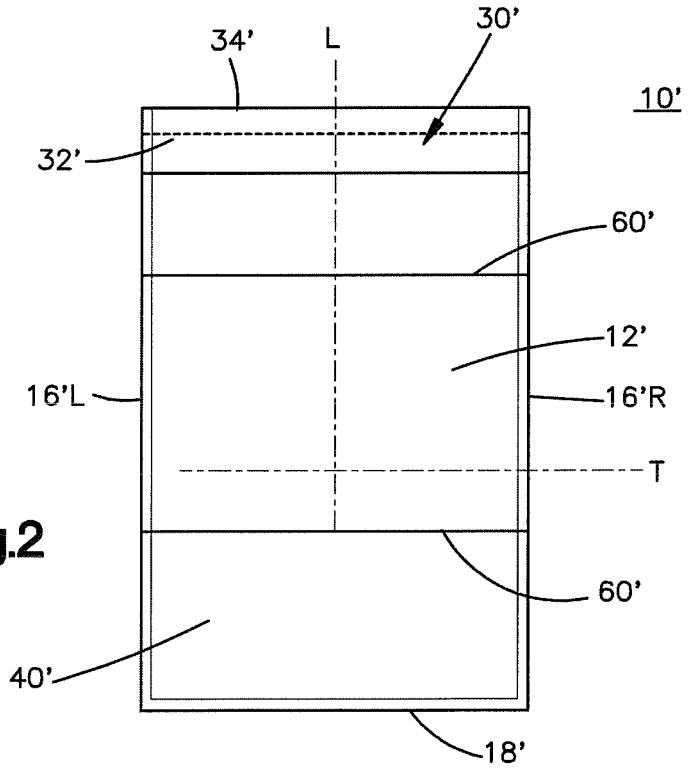
FIG. 2 is top view of a second embodiment flexible package including stiffening ribs.

FIG. 2 is an example of a sealed padded mailer 10' that includes an upper sidewall 12' and an underside sidewall 14' (not shown in FIG. 2). Sidewalls 12' and 14' are joined together at lateral seams 16'L and 16'R. The heat-sealed seams 16'L, 16'R, and 30' are illustrated schematically by a dash lines. Sidewalls 12' and 14' are also joined together at a fold 18' at the bottom of mailer 10'. On the opposing side of bottom fold 18' are edges of the sidewalls 12' and 14' that form an opening 30'. Mailer 10' forms a longitudinal axis L and a transverse axis T. A pair of transversely oriented ribs 60' are formed in sidewall 12' and optionally in sidewall 14' (not shown).

A tab 32' extends from above opening 30', which after filling mailer 10' with an item, can be folded over to enclose mailer 30'. A self-adhesive, as illustrated in FIG. 2 is a peel-and-stick strip 34' is located on the inboard side to enable tab 32' to be affixed to an exterior of sidewall 12'.

A cover layer 40', as illustrated in the Figures, preferably is a conventional polymer film, such as LDPE, HDPE, or the like, or without limitation any of the materials listed above relating to the sidewalls. A padded layer 50' (optional) is within cover layer 40'. Padded layer 50' in the embodiment of the figures includes gas-filled cells that perform the cushioning function. The cells illustrated in the figures illustrated as gas filled, and other configurations and structures are contemplated, in accordance with any means for achieving the lateral stiffness described herein.

The embodiments of the figures provide examples of structures that change the stiffness of the mailer. The present invention is not limited to the particular structures shown in the figures, but rather encompass variations and combinations that will be clear to persons familiar with mailer technology in view of the disclosure of the stiffening aspects herein.

Figure 3:
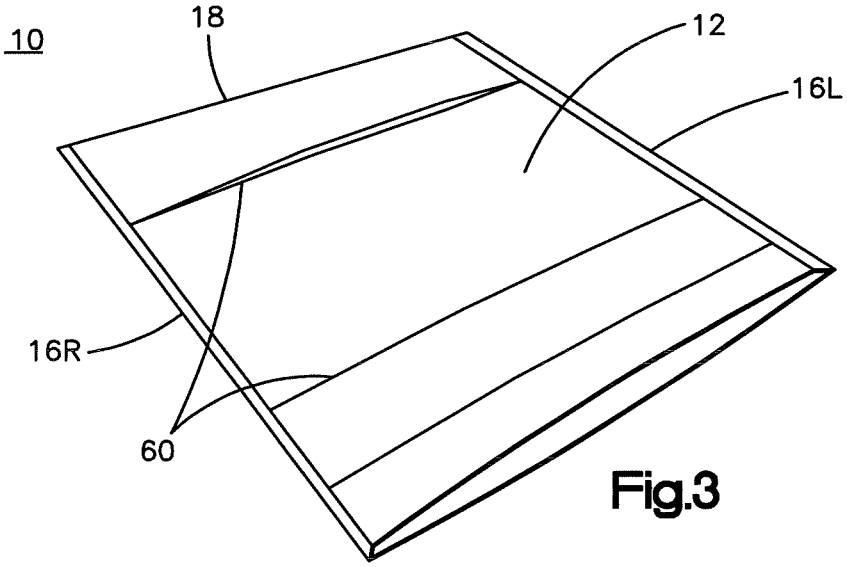
FIG. 3 is a perspective view of an embodiment of a flexible package.

Referring to FIG. 3, an unfilled mailer 10 in a perspective view illustrates a pair of transversely oriented ribs 60. The rib 60 is illustrated as transverse. The present invention includes ribs that are not parallel to transverse direction T, but rather includes a transverse component and a longitudinal component such that the rib 60 is in angled relative to the transverse direction T.

Figure 4:
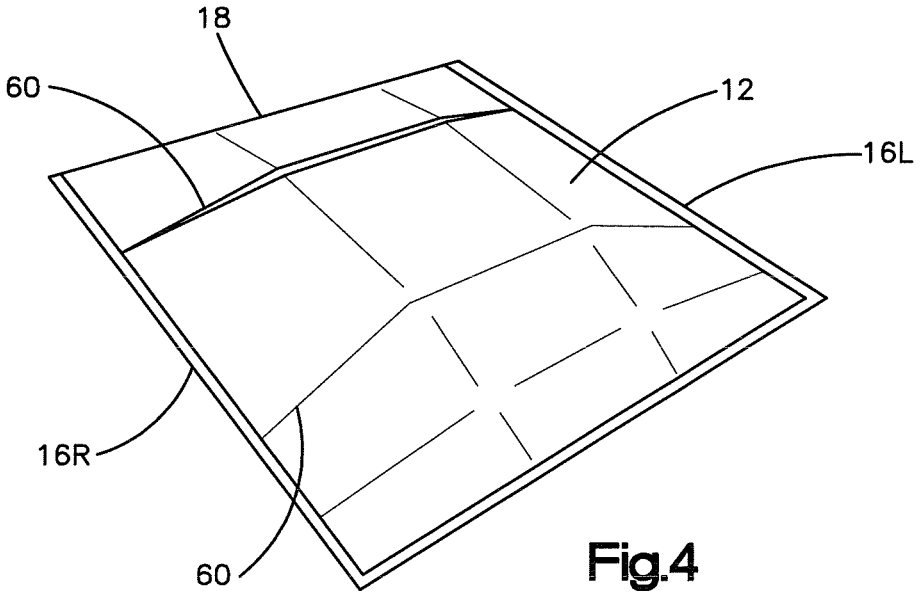
FIG. 4 is a perspective view of the embodiment of FIG. 3 is a filled configuration.

FIG. 4 illustrates mailer 10 in a filled configuration, in which ribs 60 provide stiffness to sidewall 12 that diminishes the likelihood of mailer 60 flipping about the longitudinal axis L.

Figure 5:
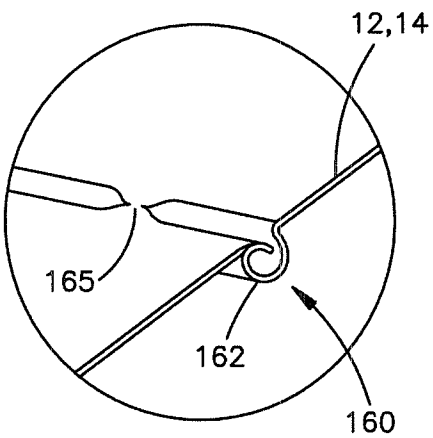
FIG. 5 is an enlarged perspective view of a first embodiment rib for stiffening a flexible package.

FIG. 5 illustrates the structure of a first embodiment rib 160 formed in either one or both of sidewalls 12 and 14. Rib 160 includes a roll 162 of the sidewall material that is held in place by a spot weld 165. In this regard, a weld or spot weld refers to portions of the sidewall or material that are joined together by any means, such as without limitation applying heat, ultrasonic waves, laser energy, induction (such as in the presence of a metal foil), adhesives, and like means.

Figure 6:
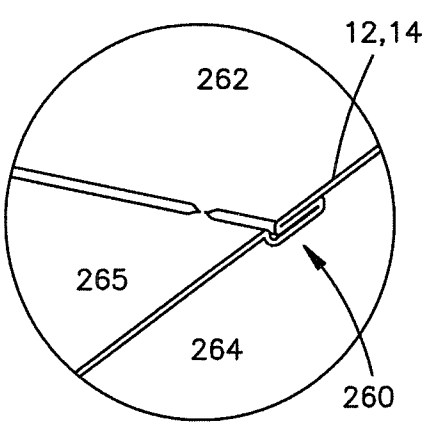
FIG. 6 is an enlarged perspective view of a second embodiment rib for stiffening a flexible package.

FIG. 6 illustrates the structure of a second embodiment rib 260 formed in either one or both of sidewalls 12 and 14. Rib 260 includes a fold formed by an inboard portion or layer 262 and an outboard layer 264 that is folded over inboard portion 262. In this regard, each one of the layers 262 and 264 are formed by folding the sidewall material such that the layers are continuous with the sidewall 12,14 and each other. The shorthand 12,14 (and others) is used herein to refer to either or both sidewalls. The sidewall of the material 12,14 is in contact with a first side of layer 262, and an opposing second side of layer 262 is in contact with a first side of layer 264. The rib 260 is illustrated as including two layers (that is 262 and 264). Additional folds forming additional layers on top of layer 264 are contemplated.

Each layer 262 and 264 thus include a flat portion that is parallel with the sidewall 12, 14. The term "parallel" is used in an approximate way such that perfect geometric parallelism is not required. A spot weld 265 holds the portions or layers 262 and 264 of the rib together. The layers 262 and 264 may also be held together and with wall 12,14 continuously.

Figure 7:
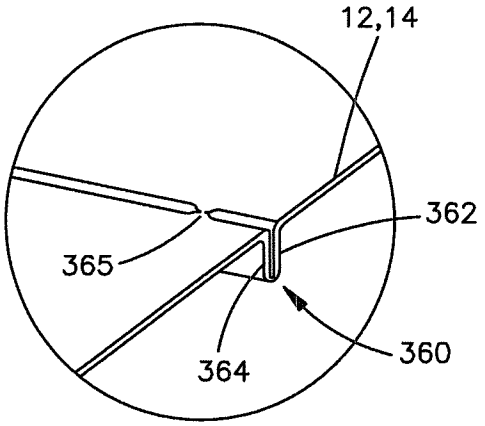
FIG. 7 is an enlarged perspective view of a third embodiment rib for stiffening a flexible package.

FIG. 7 illustrates a rib 360 that is formed by a folding a portion of the sidewall 362 against another portion of the sidewall 364. FIG. 7 illustrates that portions 362 and 364 are held together by a spot weld 365. The layers 362 and 364 may also be held together continuously.

Rib 360 as viewed in FIG. 7 has a long axis (that is, in transverse cross-section of the rib, such that the rib extends normal to the sidewall) that is perpendicular to the plane of sidewall 12, 14, thereby improving stiffness against bending.

Ribs 160, 260, and 360 may be formed by heated jaws that engage the sidewall 12,14 to plastically deformed the polymer sheet into the structure shown in the figures. A pusher, which may also be heated can push a portion of the sidewall into the jaws for heat sealing for forming the rib structure. Other means for forming ribs 160, 260, and 360 are contemplated.

FIGS. 9A through 10B illustrate additional embodiments of the rib. FIG. 9A is a schematic cross-sectional view illustrating a circular (when viewed in transverse cross section) rib 460*a* that is filled with a reinforcing material or structure 462*a*. FIG. 9B is a schematic view of a triangular (when viewed in transverse cross section) rib 460*b* that is filled with a reinforcing material or structure 462*b*. Ribs 460*a* and 460*b* are formed in a single layer sidewall 12 or 14.

FIGS. 10A and 10B illustrate a circular rib 460*c* and triangular rib 460*c* that include a filler material or structure 462*c* and 462*d*. Ribs 460*c* and 460*d* are formed in a double layer sidewall 12' or 14'. The fill material or structure 462*a*-462*d* may be any material that provides the stiffening function, such as without limitation a polymer or metal fiber, filament, wire, adhesive, or the like. Other fill materials are contemplated.

FIG. 11A illustrates ribs 560 formed in a sidewall 12 or 14 from a thermal or curing process. Ribs 560 in the embodiment of FIG. 11A is an expanded region, which may be formed of the material forming sidewall 12 or 14, or may be formed by exposing an expanding adhesive to microwaves or other thermal or other energy, as is known in the field. FIG. 11B illustrates ribs 560*b*, which may be formed in locations as desired to enhance the structure of the package, such as the grid of ribs 560*b*.

FIG. 11C illustrates a mask 570 that shields portions 580 of the package from the energy applied to the package, such as thermal radiation, UV light, microwave, or the like, depending on the expanding adhesive employed. Upon the surface of the package being exposed to the energy, the sidewall expands to forms ribs 560*a* and/or 560*b*.

A coating or additive may be used in the regions of ribs 560*a* and/or 560*b* to enhance the rib-forming process. And the energy application process may produce hardened (and therefore stiffer) portions that do not expand to achieve the stiffening function by a curing process. Offgas or heat waves 575 is illustrated in FIG. 11C to illustrate the energy application process and may or may not occur depending on the particular process employed.

FIGS. 12A and 12B illustrate a package having ribs formed of a foam. As illustrated, each one of sidewall 12 and 14 includes ribs 660. Any foam material may be employed, such as polyethylene, polyurethane, EVA, or any other foam material that can provide stiffening. Ribs 660 may be formed integrally with sidewalls 12 or 14 or may be adhered or welded or otherwise affixed to the sidewall 12, 14 by any means. FIG. 12B illustrates a sheet 690 of material having ribs 660 pre-formed into the sheet. Sheet 690 may be fed into a machine for forming a mailer, as described more fully below, or may be formed into a flexible package by any other means, as well understood in the packaging field.

FIGS. 13A through 13E illustrate additional reinforcing or stiffening structure, designated 760*a* through 760*e*. Rib 760*a* in the embodiment of FIG. 13A is a V-shaped structure that is between portions of sidewall 12, 14, which flexible portions are designated as 712 and 714. Thus, the sidewall 712, 714 in the embodiment of FIGS. 13A through 13E includes structural ribs 760*a* through 760*e*, which in the embodiment shown are rigid, and flexible sidewalls between the ribs. Ribs 760*a* through 760*e* may be formed of any material, such as without limitation those described herein for forming other ribs.

Ribs 760*a* include a v-shaped cross-sectional profile with edges or wings that yield to, or merge into, or are attached to flexible sidewall at each end thereof. FIG. 13B illustrates ribs 760*b*, which in the embodiment shown are a pair of ribs 760*b* (having the same structure of first ribs 760*a*) configured to provide two ribs on each sidewall 12 and 14 of the flexible package. Rib 760*c* of FIG. 13C illustrates a rib having a semi-circular cross-sectional profile with edges or wings that yield to, or merge into, or are attached to flexible sidewall at each end thereof.

The frame structure 760*d* of FIG. 13D includes members 762 and 764 that in the embodiment shown form a rectangle. A space 766 is formed at the interior of the rectangle formed by members 762 and 764. Rectangular stiffener 760*e* of FIG. 13E illustrates that the width W of any of the ribs and structure described herein is one parameter to achieve the desired stiffening. The frame 760*d* and rectangle 760*e* dimensions, stiffness, and location may be chosen according to the desired parameters and uses of the flexible package, as will be understood by persons familiar with package design in view of the present disclosure. Structures 760*a* through 760*e* may be formed of any material that achieves the desired stiffening function.

FIGS. 14A through 18 illustrate stiffening inclusions 860*a* through 860*e*, each of which preferably includes a stiff member that is embedded in sidewall 812 and 814. Inclusions 860*a* through 860*c* and 860*e* through 860*g* are elongate, thin members, such as (without limitation) filaments, wires, tubes, and the like that are capable of adding stiffness to the flexible sheets or membranes 812, 814. The inclusions may be embedded into sheets 812 and/or 814, such (without intending the method of embedding the inclusions to be limiting) as forming the sheets having the inclusions embedded therein.

Inclusions 860*a* of FIGS. 14A and 14B form a parabolic shape, and any curved and/or open-ended shape may be employed. The parabolic inclusions of FIG. 14B are identified by reference number 860*b* to indicate that both sidewalls 812 and 814 include inclusions 860*b*. Inclusion 860*c* of FIG. 15A forms an oval or ellipse, and any curved, closed-ended shape may be employed. Inclusion 860*d* of FIG. 15B forms a rounded-edge rectangle, and any close-ended or open ended shape having rectilinear portions may be employed. Inclusion 860*c* also illustrates an inclusion having a dimension in one direction that is greater than a dimension in the normal direction (when viewed from above), such that inclusion 860*c* may be referred to as a web or flat bar.

FIG. 16 illustrates inclusions 860*e*, which include several longitudinal inclusions 862*e* that connect to or merge with a pair of lateral inclusions 864*e*. Inclusions 862*e* may be affixed to inclusions 864*e* or may be unconnected and/or mutually spaced apart.

FIGS. 17A and 17B illustrate a pattern of inclusions 860*f* that are oriented to or toward the four corners of the package such that when the package is expanded, portions of the sidewalls 812, 814 form inclined side panels 862*f* In some circumstances, the region 864*f* between inboard ends of the inclusions 860*f* form a panel 864*f* that is bounded by side panels 862*f*. FIG. 17B illustrates that inclusions 860*f* may be formed on each one of sidewall 812 and 814. FIG. 18 illustrates inclusions 860*g*, including zig-zag inclusions 862*g* that extend in a triangular or zig-zag pattern about the peripheral edges of the flexible package. An inboard edge or boundary of the triangles of zig-zag inclusions 862*g* includes a boundary inclusion 863*g*. Accordingly, boundary inclusion 863*g* defines a panel 864*f* of wall 812 and/or 814. The inclusions 860*a* through 860*g* are referred to herein as ribs.

FIGS. 19A through 19C include stiffeners formed as debosses (that is, recesses, which may be pressed into the sidewalls) in wall 912 and/or 914. FIGS. 20A and 20B include stiffeners formed as embosses (that is, raised portions, which may be pressed into the sidewalls from their inboard sides) in wall 912 and/or 914. Deboss 960*a* of FIG. 19A is a rectangular region that creates a continuous rectangular sidewall 962*a* such that at least a portion of sidewall 962*a* is substantially vertical or upright (in the orientation of the figures) to enhance the stiffening function. Deboss 960*b* of FIG. 19B includes a pair of transversely oriented rectangles that form continuous, rectangular sidewalls 962*b*. Each continuous rectangular sidewall 962*b* is such that at least a portion of sidewall 962*a* is substantially vertical or upright (in the orientation of the figures) to enhance the stiffening function. Deboss 960*c* of FIG. 19C includes plural, parallel, transverse ridges, which may be an emboss that forms a substantially vertical or upright continuous sidewall or may be corrugations.

Emboss 960*d* of FIG. 20A is a raised structure that is a mirror image of the deboss of FIG. 19A, including a continuous rectangular sidewall 962*d* such that at least a portion of sidewall 962*a* is substantially vertical or upright (in the orientation of the figures) to enhance the stiffening function. Emboss 960*e* of FIG. 20*b* includes three transversely oriented grooves that include vertical or upright continuous walls 962*e* to enhance the stiffening function. The embosses and debosses of FIGS. 19A through 20B are described as having an upstanding portion. A portion that is not purely vertical, but includes a vertical component (when the sidewall is horizontal) such that the wall of the emboss and/or deboss is oriented at an oblique angle to the sidewall is also contemplated. The upstanding or oblique portions of debosses 960*a*, 960*b*, and 960*c* and embosses 960*d* and 960*e* are referred to herein as ribs.

FIG. 21 is a sheet 1012', 1014' for forming sidewalls of a flexible package. The sidewalls 1012 and 1014 (formed from sheet 1012', 1014') include corrugations 1020, which preferably are oriented transversely in the flexible package. Ribs 1060 are formed of plural corrugations being joined together. In the enlarged end view of the FIG. 22, rib 1060 is formed of four corrugations joined together and oriented vertically or upright. Any number of corrugations may be used to form the rib 1060. Rib 1060 preferably is oriented transversely relative to the package. The layers or corrugations of rib 1060 may be held together by any means, including without limitation gluing, welding, mechanical fasteners of any type, and any other means.

FIGS. 23A and 23B illustrate a sheet 1112', 1114' for forming sidewalls of a flexible package. The sidewalls 1112 and 1114 (formed from sheet 1112', 1014') include a film or sheet substrate 1118 and an expanded polymer, plastic wire mesh, or other material reinforcing structure 1120 adhered to substrate 1118 or formed integral with or embedded in substrate 1118. Ribs 1160 are formed of collapsed or unexpanded portions of expanded reinforcing structure 1120. Preferably, ribs 1160 are formed transversely, and may be held together by any means, including without limitation gluing, welding, mechanical fasteners of any type, and any other means.

FIGS. 24A and 24B illustrate ribs 1260*a* and 1260*b* in sidewall 1212 and/or 1214. Rib 1260*a* is curved and rib 1260*b* is straight or rectilinear, and each are roughly transversely oriented. Ribs 1260*a* and 1260*b*, as illustrated in the figures, are formed of two separate materials that are separated by a membrane or barrier. Upon bending sidewall 1212,1214, such as can occur when opening the mouth of the package when loading an item in the package, the two materials mix (such as when the barrier between the materials is broken) and harden to form a stiffening rib.

FIGS. 25A and 25B illustrate channels 1360 formed in sidewalls 1312 and/or 1314. Channel 1360, which is illustrated in enlarged cross section in FIG. 25C, may be formed by chemical means (such as without limitation wet or dry etching and the like), mechanical means (such as without limitation laser scoring, die punching, cutting, planing, and the like), or any other means.

Channels 1360 form a hinge that enables sidewall portions 1312, 1314 to hinge about channels 1360. Accordingly, as best illustrated in FIG. 25B, sidewall portions 1312, 1314 can deform into sections bent about channels 1360.

Figure 25D:
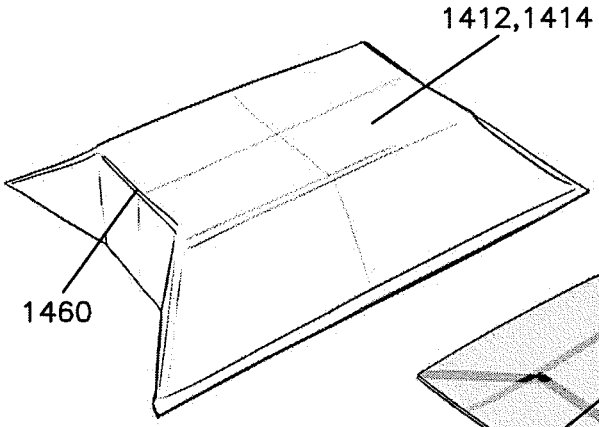
FIG. 25D is a perspective view illustrating the mailer of FIG. 25E having an item that has been inducted therein.
Figure 25E:
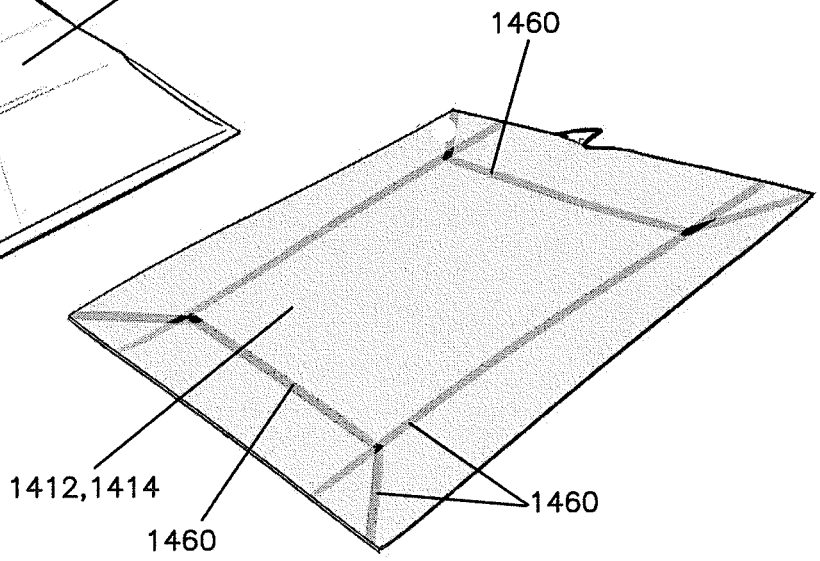
FIG. 25E is a perspective view of a mailer having weakened or thinned portions that form hinges in the sidewall of the mailer.

FIGS. 25D and 25E include hinges 1460 in sidewalls 1412, 1414. Hinges 1460 are formed by moisture or a solvent applied to the sidewalls that form weakened portions to enable bending about hinges 1460.

Figures 26A, 26B, 26C, 26D:
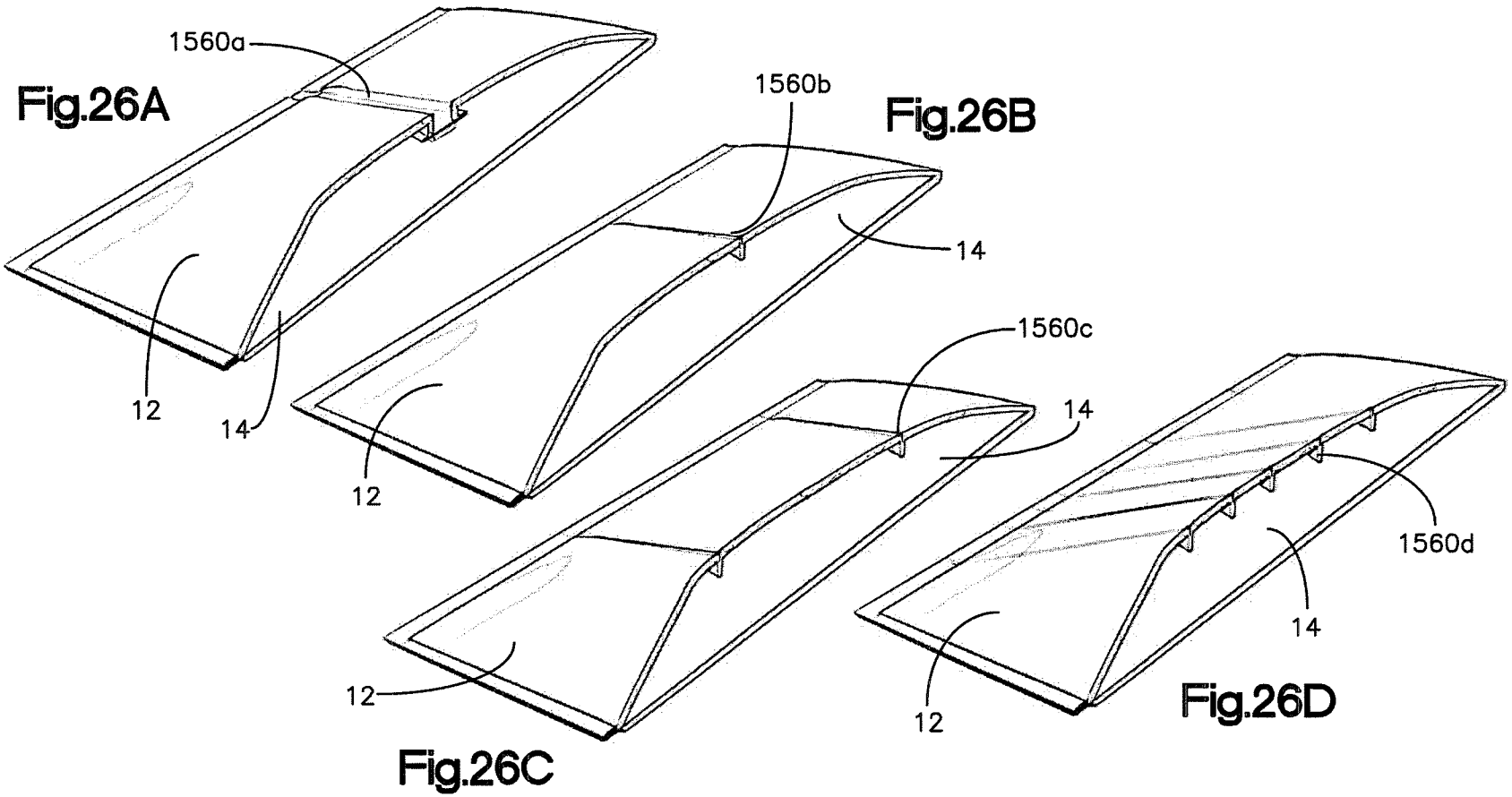
FIG. 26A is an illustration of a first embodiment seam.
FIG. 26B is an illustration of a second embodiment seam.
FIG. 26C is an illustration of a third embodiment seam.
FIG. 26D is an illustration of a fourth embodiment seam.

The quantity and locations of ribs can be chosen according to the desired properties of the package, as explained more fully herein. FIG. 26A through FIG. 26D illustrate examples or rib or seam orientation. FIG. 26A illustrates a channel-like seam 1560*a*. FIG. 26B illustrates a single seam 1560*b* formed by a fold in sidewall 12, which fold may be formed by any means. FIG. 26C illustrates a pair of parallel folds 1560*c*, each of which may be identical to fold 1560*b*. FIG. 15D illustrates plural folds 1560 (in the embodiment of FIG. 26D, five folds), each of which may be identical to fold 1560*b*.

As illustrated in the FIGS. 26A through 26D, the present invention encompasses a single seam in one of the sidewalls 12 or 14, a pair of seams in one of the sidewalls 12 or 14, and/or plural seams in one of the sidewalls 12 or 14. Further, the seams may be formed in each one of the sidewalls 12 and 14. As illustrated in FIGS. 26A through 26C, the seams may be oriented transversely relative to the package. As illustrated in FIG. 26D, the seam may be oriented at an oblique angle relative to the transverse direction. Further, the description of the numerous orientations of the seams also applies to the numerous orientations of any of the seams disclosed herein. FIGS. 26A through 26D use the reference numbers 12 and 14 to refer to the sidewalls, and the orientations and principles illustrated in FIGS. 26A through 26D may be employed with any of the ribs and sidewalls described herein.

Figure 8B:
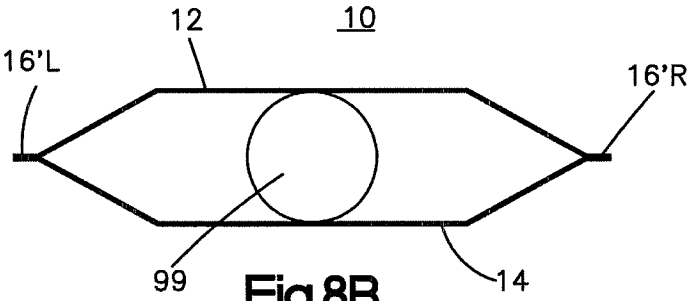
FIG. 8B is an end cross-sectional view of the mailer of FIG. 8A.
Figure 8A:
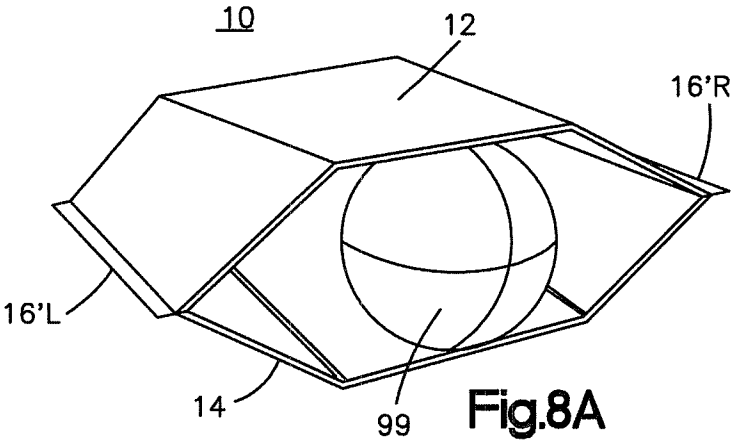
FIG. 8A is a perspective cross-sectional view of a mailer having a spherical item placed therein.

Various configurations of the rib have been disclosed as examples of stiffening structures that may be employed. The present invention is not limited to the particular structures disclosed herein, as (for example) other rib configurations may be formed and features of the disclosed gussets can be combined or duplicated in a single rib. FIGS. 8A and 8B illustrate a cross section of a mailer 10 having an item 99 housing within the mailer. Sidewalls 12 and 14 deflect to receive item 99. Portions of sidewalls 12 and 14 are identified by reference number 90 as stiffened portions. In some circumstances, stiffened portions 90 will resist bending or deforming if mailer 10 would tend to flip over either end 16'R or 16'L, rather than merely bending with no resistance.

The sheets 110 through 710 or any of the structures in any of the figures are intended to be fed from a continuous roll during the formation of the mailers from the sheets. For example, a roll of the sheet 110-710 may be fed downwardly and partially folded at area 118 through 718. The hinges and like features of the cells described above promote the folding process.

Then the edges are heat sealed for enclose three sides to complete the formation of the mailer 10. Preferably the self-adhesive strip 34 is pre-formed on the roll of material. Alternatively, after folding, a first edge can be heat sealed, and then an item inserted into the package before sealing the second edge and the mouth of the package.

The mailer as described may be formed by any means, as will be understood by persons familiar with mailer technology. The present invention has been described by employing examples of structure and function of the gas-filled structures and mailers. The present invention is not intended to be limited to the particular structure or function of the structures disclosed herein unless expressly stated in the claims. Rather, the invention encompasses the structure(s) and function(s) defined in the claims and understood by persons familiar with packaging technology. For non-limiting example, the dimensions and materials may be chosen according to the particular goals of the mailer according to well understood principles. The features of the various embodiments may be combined with one another according to the broad interpretation of the teachings in the specification and claims. Further, advantages of the structure and function have been described for context of the invention only. It is not intended that the present invention be limited to any advantage unless expressly stated in the claims.

What is claimed is:

1. A flexible packaging comprising:

opposing first and second sidewalls that are joined at lateral edges thereof, that have a closed bottom edge and open top edges opposite the bottom edge to define an interior configured to receive an item, wherein each of the first and second sidewalls includes a flexible cover-layer and an inner, padded layer, wherein the padded layer is made of a plastic, and wherein the inner, padded layer includes a plurality of individual cells, wherein at least one of the first sidewall or the second side sidewall includes a structural component extending in a direction transverse to the lateral edges and between the bottom edge and the top edges of the first and second sidewalls, wherein the structural component includes a fold or bend integrally formed with the flexible cover layer and the padded layer and extending into the interior of the flexible packaging, and wherein the structural component increases the lateral stiffness of the flexible packaging.

2. The flexible packaging of claim 1, wherein the padded layer comprises a plurality of gas-filled cells.

3. The flexible packaging of claim 1, wherein the first and second sidewalls are formed from a continuous cover-layer that is folded at a bottom edge of the first and second sidewalls.

4. The flexible packaging of claim 3, wherein the first sidewall comprises an adhesive at the top edge, the adhesive being configured to be affixed to the second sidewall.

5. The flexible packaging of claim 1, wherein the structural component comprises a first structural component in the first sidewall and a second structural component in the second sidewall.

6. The flexible packaging of claim 1, wherein the structural component comprises a first structural component and a second structural component in the first sidewall or the second sidewall, wherein the first structural component and the second structural component are spaced apart along the lateral edges.

7. The flexible packaging of claim 1, wherein the structural component comprises at least two spaced structural components in the first sidewall and at least two spaced structural components in the second sidewall.

8. The flexible packaging of claim 1, wherein the padded layer is made of a plastic.

9. The flexible packaging of claim 1, wherein the lateral edges of the first and second sidewalls are heat-sealed to join the first and second sidewalls.

10. A mailer having opposing lateral edges, a top edge, and a bottom edge to define an interior configured to receive an item, the mailer comprising:

a flexible cover-layer;

an inner, padded layer, wherein the padded layer is made of a plastic, and wherein the inner, padded layer includes a plurality of individual cells; and a structural component extending in a direction transverse to the lateral edges between the bottom edge and the top edge, wherein the structural component includes a fold or bend deformed with the flexible cover layer and the padded layer and extending into the interior of the mailer, and wherein the structural component increases the lateral stiffness of the mailer.

11. The mailer of claim 10, wherein the fold or the bend is heat sealed.

12. The mailer of claim 10, wherein the flexible cover-layer and the padded layer are folded at the bottom edge to form a first sidewall and a second sidewall opposing the first sidewall.

13. The mailer of claim 12, wherein the cells include round cells near the bottom edge.

14. The mailer of claim 10, wherein the mailer comprises a first sidewall and a second sidewall joined at the lateral edges and the bottom edge.

15. The mailer of claim 14, wherein the first sidewall comprises an adhesive at the top edge, the adhesive being configured to be affixed to the second sidewall.

* * * * *